US011661765B2

(12) United States Patent
Wang

(10) Patent No.: US 11,661,765 B2
(45) Date of Patent: May 30, 2023

(54) LOCK AND LID LOCK FOR APPLIANCE

(71) Applicant: Illinois Tool Works Inc., Glenview, IL (US)

(72) Inventor: Yang Wang, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 372 days.

(21) Appl. No.: 16/956,195

(22) PCT Filed: Dec. 19, 2018

(86) PCT No.: PCT/US2018/066482
§ 371 (c)(1),
(2) Date: Jun. 19, 2020

(87) PCT Pub. No.: WO2019/133380
PCT Pub. Date: Jul. 4, 2019

(65) Prior Publication Data

US 2021/0002921 A1 Jan. 7, 2021

(30) Foreign Application Priority Data

Dec. 25, 2017 (CN) ..... 201711423849.X

(51) Int. Cl.
*E05B 47/00* (2006.01)
*D06F 39/14* (2006.01)
(Continued)

(52) U.S. Cl.
CPC ..... *E05B 47/0012* (2013.01); *D06F 39/14* (2013.01); *E05B 9/02* (2013.01);
(Continued)

(58) Field of Classification Search
None
See application file for complete search history.

(56) References Cited

U.S. PATENT DOCUMENTS 4,170,374 A 10/1979 Garcia
2016/0356059 A1 12/2016 Newman

FOREIGN PATENT DOCUMENTS

DE 19526660 A1 1/1997
DE 19526660 B4 * 1/1997 ..... E05B 47/00
DE 102011010439 A1 8/2011

OTHER PUBLICATIONS

International Preliminary Report on Patentability for PCT/US2018/066482 dated Jul. 9, 2020.
(Continued)

*Primary Examiner* — Thomas S McCormack
(74) *Attorney, Agent, or Firm* — Boyle Fredrickson, S.C.

(57) ABSTRACT

A lock and lid lock for an appliance are provided. The lock has a base supporting a driving mechanism, a sliding mechanism, a connecting mechanism and a locking mechanism. The driving mechanism includes a driving unit that drives rotation of a screw rod. A sliding block is connected to a gear that is engaged with the screw rod and drives the sliding block to move linearly back and forth with the rotation of the screw rod. One end of the connecting mechanism is connected to the sliding block and the other end is connected to the locking mechanism. This allows linear movement of the sliding block to be converted into rotational movement of the locking mechanism. The locking mechanism is rotatably connected to the base and may include a locking portion which is configured to unfold or retract relative to the base along with the rotation of the locking mechanism.

16 Claims, 7 Drawing Sheets

(51) Int. Cl.
*E05B 9/02* (2006.01)
*D06F 34/10* (2020.01)

(52) U.S. Cl.
CPC ..... *E05B 47/0001* (2013.01); *D06F 34/10* (2020.02); *E05B 2047/002* (2013.01); *E05B 2047/0016* (2013.01); *E05B 2047/0017* (2013.01)

(56) References Cited

OTHER PUBLICATIONS

International Search Report for PCT/US2018/066482 dated Mar. 22, 2019.

* cited by examiner

LOCK AND LID LOCK FOR APPLIANCE

TECHNICAL FIELD

The present application relates to a mechanical lock, and in particular to a lock and a lid lock.

BACKGROUND

Currently, electrical appliances usually require lock mechanisms of a high security level. Take a washing machine as an example, the lid of a large cylinder washing machine needs to be locked by a lock mechanism to prevent possible harms to human body when the washing machine runs at a high speed (or when the machine still runs at a high speed after being turned off due to inertia).

However, most locks are complex to operate with, occupy a large space and may not be manually unlocked conveniently.

SUMMARY

A lock and a lid lock are provided according to embodiments of the present application, to solve or alleviate at least one or more technical challenges in the existing technology, and at least to provide a helpful choice or create a favorable condition for this purpose.

To implement the above objects, in one aspect of the present application, a lock is provided according to an embodiment of the present application. The lock includes a base, and a driving mechanism, a sliding mechanism, a connecting mechanism and a locking mechanism which are disposed on the base. The driving mechanism includes a driving unit and a screw rod, the driving unit driving the screw rod to rotate. The sliding mechanism includes a gear and a sliding block connected to the gear, the gear being engaged with the screw rod, to drive the sliding block to move linearly. The connecting mechanism comprises a first end connected to the sliding block, and a second end connected to the locking mechanism, the connecting mechanism converting the linear movement of the sliding block into rotational movement of the locking mechanism. The locking mechanism is rotatably connected to the base and comprises a locking portion to unfold or retract relative to the base along with the rotation of the locking mechanism.

In an embodiment, the sliding mechanism comprises a pair of gears which engage on opposite two sides of the screw rod symmetrically.

In an embodiment, the gear is connected to the sliding block via a gear shaft; and an elastic element is disposed between the gear and the gear shaft for providing a frictional force between the gear and the gear shaft to prevent a relative rotation therebetween.

In an embodiment, the gear shaft has a stepped contour and includes a first stepped portion and a second stepped portion; the inner surface of the gear is matched with the stepped contour of the gear shaft and comprises a first stepped surface corresponding to the first stepped portion, and the elastic element is clamped on the first stepped portion and is in interference fit with the second stepped surface.

In an embodiment, the elastic element is sheathed on the gear shaft and includes a protruding end clamped in a recess in the inner wall of the gear.

In an embodiment, the sliding block includes a guide portion; the guide portion includes an extension portion perpendicular to the movement direction of the sliding block and comprising a guide hole, the screw rod passing through the guide hole of the guide portion; and a gap is provided between the guide hole and the screw rod.

Another aspect of the embodiments of the present application provides a lid lock structure, comprising an upper lid, a casing and the above-mentioned lock, wherein the upper lid is configured to be buckled to the casing; the lock is configured to be disposed in the casing, and a locking hole being disposed in the upper lid at a position corresponding to the lock; and the locking portion is configured to be rotatable relative to the casing to extend out of the same, for being locked in the locking hole.

In an embodiment, the lock is arranged in the casing in a vertical manner, and the locking portion rotates outwards towards the upper portion of the casing.

In an embodiment, the lock is arranged in the casing in a horizontal manner, and the locking portion rotates outwards towards the inner side of the casing.

In an embodiment, a gap is provided between the upper lid and the casing, to accommodate a sheet-like plate which slides therein.

The above summary only intends to illustrate the purpose of the description, and does not intend to be limiting in any form. In addition to the above described illustrative aspects, embodiments and features, further aspects, embodiments and features of the present application will be readily understood by reference to the accompanying drawings and the detailed description below.

BRIEF DESCRIPTION OF THE DRAWINGS

The same reference numerals in the drawings will be used to refer to the same or like parts or elements throughout the drawings, unless specified otherwise. These drawings may not be necessarily drawn according to the scales. It should be understood that these drawings only depict some embodiments of the present application, and shall not be regarded as limiting to the scope of the present application.

DETAILED DESCRIPTION OF THE EMBODIMENTS

Figure 1:
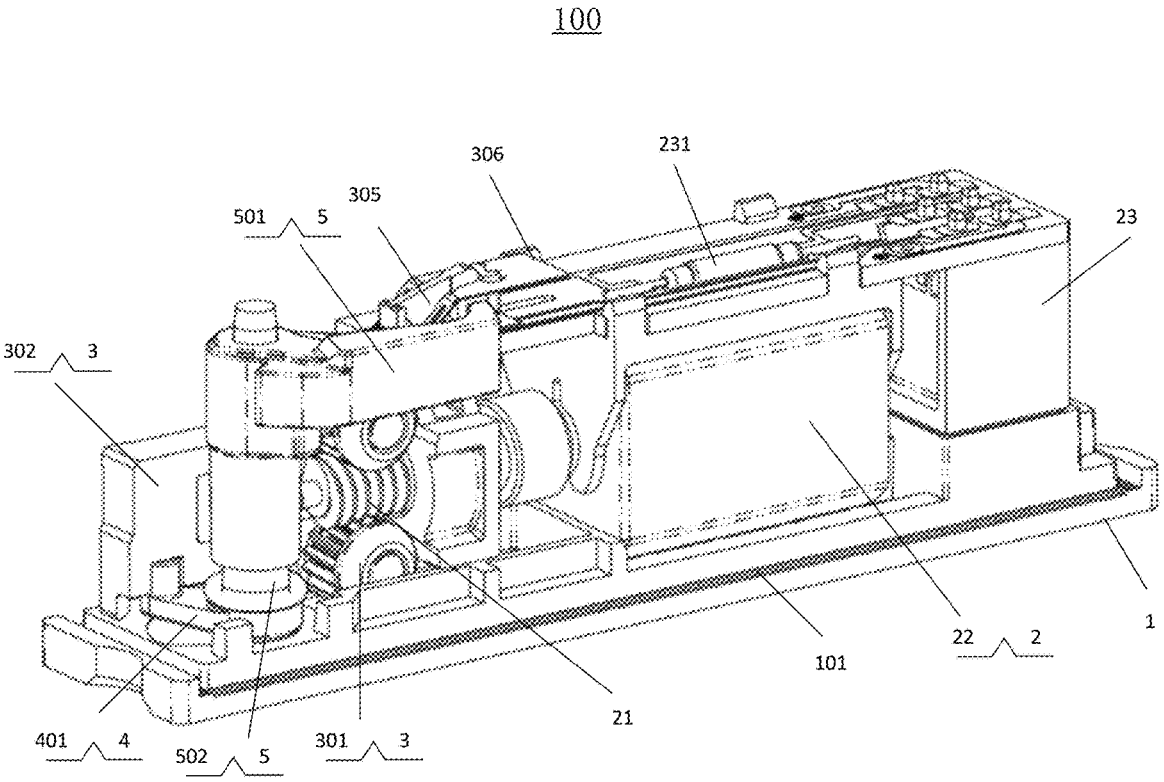
FIG. 1 is a schematic structural view of a lock according to an embodiment of the present application in which the locking portion is in a retracted state.

In the following, only some embodiments are briefly described. As can be recognized by those skilled in the art, various modifications may be made to the described embodiments without departing from the spirit or scope of the present application. Therefore, the drawings and the description are substantially regarded as exemplary intrinsically rather than restrictive.

In the first aspect of the present application, a lock 100 is provided.

The lock 100 of the present application will be described below with reference to the drawings.

Referring to FIGS. 1-7, in an embodiment, the lock 100 of the present application includes a base 1; and a driving mechanism 2, a sliding mechanism 3, a connecting mechanism 4 and a locking mechanism 5 which are disposed on the base 1.

According to an embodiment, the driving mechanism 2 includes a screw rod 21 and a driving unit 22. The driving unit 22 can drive the screw rod 21 to rotate. In addition, the driving mechanism 2 further includes a socket 23 (which will be described later).

The sliding mechanism 3 includes a gear 301 and a sliding block 302 connected to the gear 301. The gear 301 engages with the screw rod 21. Thus, when the screw rod 21 rotates, the gear 301 will also move linearly in an axial direction of the screw rod 21. Further, the gear 301 is capable of driving the sliding block 302 connected thereto to slide linearly.

The connecting mechanism 4 includes one end connected to the sliding block 302, and the other end connected to the locking mechanism 5. The connecting mechanism 4 is rotatably connected to the base 1. In this way, the linear movement of the sliding block 302 may be converted by the connecting mechanism 4 into rotation of the locking mechanism 5 relative to the base 1.

The locking mechanism 5 is provided with a locking portion 501, which may rotate along with the rotation of the locking mechanism 5 and may form different angles with the direction of motion of the sliding block 302 in the rotation process, i.e., the locking portion 501 may rotate to unfold or to retract relative to the base. It can be easily understood that the locking portion 501 has an angle range which may be set as required.

Figure 2:
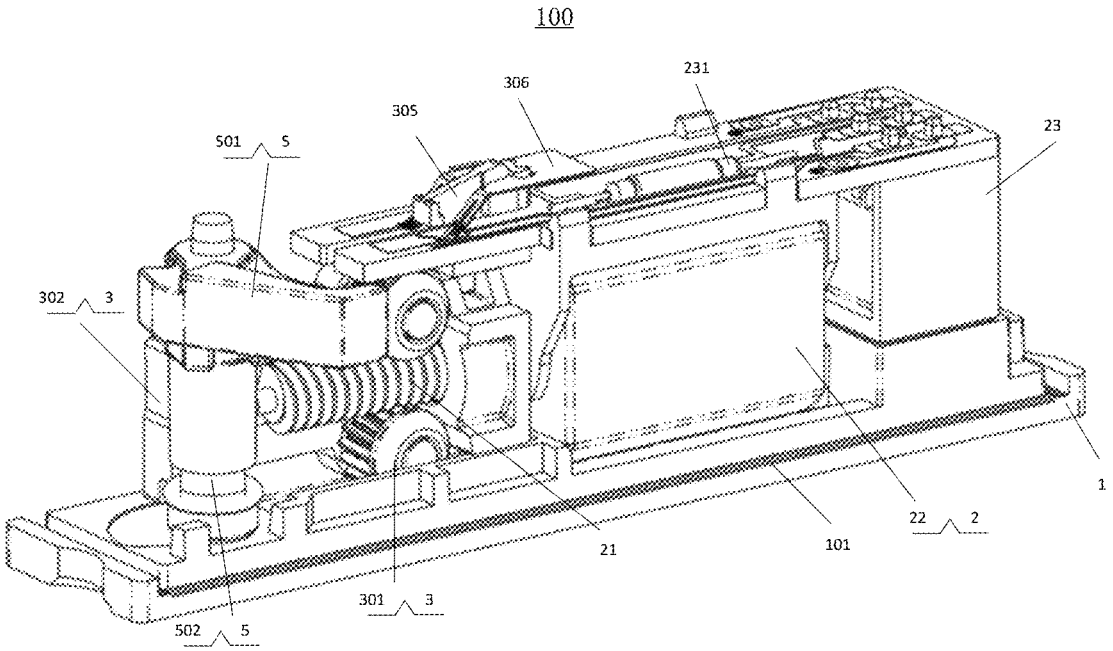
FIG. 2 is a schematic structural view of a lock according to an embodiment of the present application in which the locking portion is in an unfolded state.

In an embodiment, specifically as shown in the state transition from FIG. 1 to FIG. 2, when a locking operation is needed, the driving mechanism 2 is started, the screw rod 21 rotates forwards, and the gear 301 engages with the screw rod 21, then runs backwards and drives the sliding block 302 to move backwards. The sliding block 302 at this moment pulls the connecting mechanism 4 to rotate clockwise. Therefore, the locking portion 501 may rotate clockwise and unfold relative to the base 1 and extends into a locking hole matched therewith.

As shown in the state transition from FIG. 2 to FIG. 1, when an unlocking operation is needed, the driving mechanism 2 is started, the screw rod 21 rotates reversely, and the gear 301, engaged with the screw rod 21, moves forwards to drive the sliding block 302 to move forwards. The sliding block 302 at this moment pulls the connecting mechanism 4 to rotate counterclockwise. Therefore, the locking portion 501 may rotate counterclockwise and retract relative to the base 1, and returns to an initial position.

It should be noted that the directions such as "front", "rear", "upper" and "lower" as used herein are intended for convenience of description and do not necessarily correspond exactly to the space in practical work.

In an embodiment, the sliding mechanism comprises a pair of gears 301 which is engage on two opposite sides of the screw rod 21 symmetrically. In this way, when the screw rod 21 rotates, the pair of symmetrically engaged gear 301 jointly drive the sliding block 302 to move linearly, so that the transmission of the movement between the screw rod 21 and the sliding block 302 can be smoothed and stabilized.

Figure 3A:
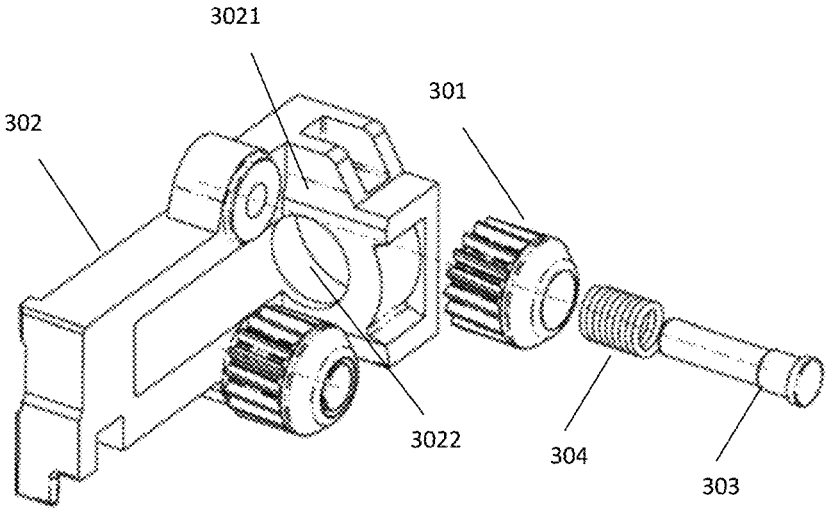
FIG. 3*a* is an exploded view of a lock according to an embodiment of the present application in which the gear is connected to the sliding block.

As shown in FIG. 3*a*, the gear 301 and the sliding block 302 are connected via a gear shaft 303. An elastic element 304 is disposed between the gear 301 and the gear shaft 303 for providing frictional force between the gear 301 and the gear shaft 303. When an external load does not exceed the frictional force supplied by the elastic element 304, the gear 301 is constrained by the frictional force and is stationary relative to the gear shaft 303. Therefore, the relative rotation between the gear 301 and the gear shaft 303 is prevented, and the gear 301 may stably move forwards along with the rotation of the screw rod 21.

Further, when the external load exceeds the frictional force provided by the elastic element 304, for example, when the sliding block 302 moves to an extreme position or the sliding block 302 is stuck in movement, the reaction force suffered by the sliding block 302 may exceed the frictional force provided by the elastic element 304, and the gear 301 at this moment starts to engage with the screw rod 21 against the frictional force and rotates relative to the gear shaft 303. In this way, the occurrence of the "jamming" phenomenon in the rotation of the screw rod 21 is avoided, the overheating of the driving mechanism 2 is prevented, and the driving mechanism 2 is protected.

As shown in FIG. 3*a*, in an embodiment, the sliding block 302 is provided with a guide portion 3021. The guide portion 3021 has an extension portion perpendicular to the movement direction of the sliding block 302. The extension portion may have a guide hole 3022. The screw rod 21 passes through the guide hole 3022. In this way, the guide hole 3022 may guide the screw rod 21. In addition, a gap is provided between the guide hole 3022 and the screw rod 21, which may prevent the guide hole 3022 interfering the movement of the screw rod. The guide portion 3021 may be disposed at one side, close to the driving unit 22, of the sliding block 302.

Figure 4:
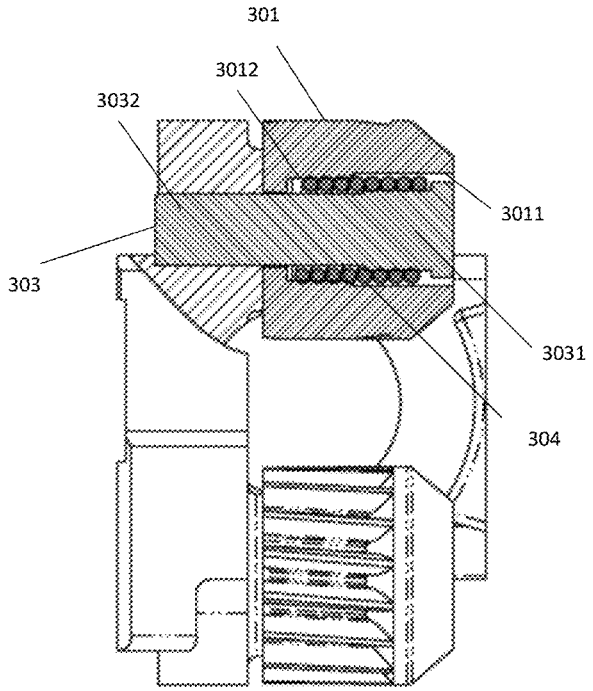
FIG. 4 is a partial cross-sectional view of a lock according to an embodiment of the present application in which the gear is connected to the sliding block.

As shown in FIG. 4, in an embodiment, the gear shaft 303 has a stepped contour and includes a first stepped portion 3031 and a second stepped portion 3032. The inner surface of the gear 301 may be designed to be matched with the stepped contour of the gear shaft 303, which includes a first stepped surface 3011 corresponding to the first stepped portion 3031 and a second stepped surface 3012 corresponding to the second stepped portion 3032. The elastic element 304 may be clamped on the first stepped portion 3031 and is in interference fit with the second stepped surface 3012. Therefore, the elastic element 304 provides frictional force between the gear 301 and the gear shaft 303.

Figure 3B:
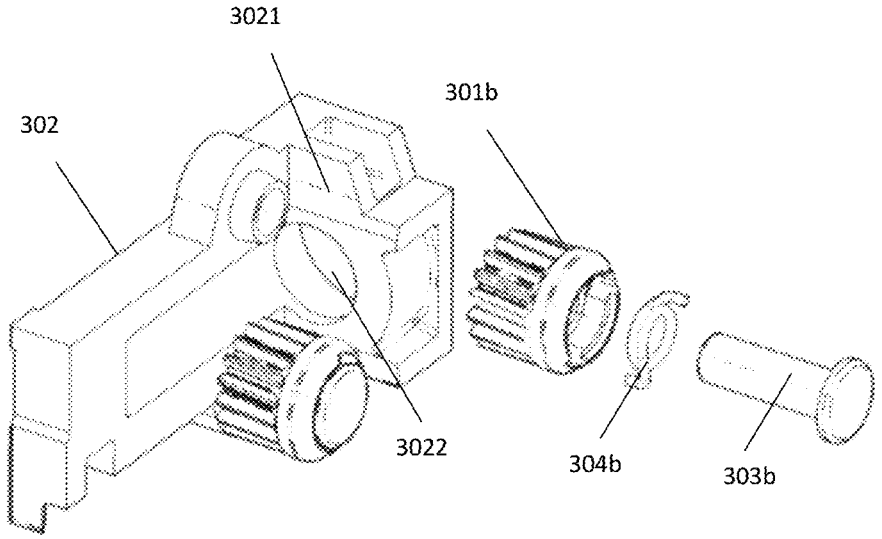
FIG. 3*b* is an exploded view of a lock according to another embodiment of the present application in which the gear is connected to the sliding block.
Figure 3C:
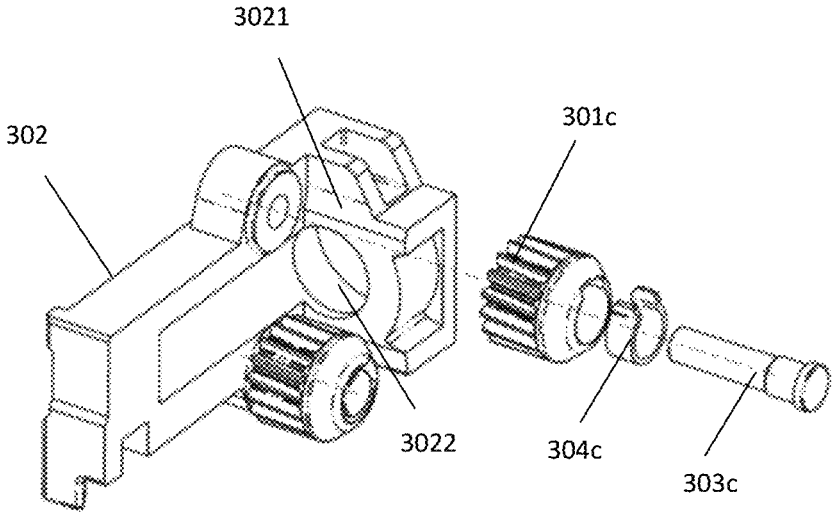
FIG. 3*c* is an exploded view of a lock according to still another embodiment of the present application in which the gear is connected to the sliding block.

As shown in FIGS. 3*b* and 3*c*, the elastic element is sheathed on the gear shaft and includes a protruding end clamped in a recess in the inner wall of the gear. As shown in FIG. 3*b*, in an embodiment, the elastic element between the gear and the gear shaft is shown as the reference numeral 304*b*. The elastic element 304*b* is formed by winding, and includes a winding start end and a winding termination end, namely, the protruding ends. The elastic element 304*b* is sheathed on the gear shaft 303*b*. Recesses matched with both the winding start end and the winding termination end are disposed in the inner wall of the gear 301*b*. The winding start end and the winding termination end are clamped in the recesses of the gear 301*b*. The elastic element 304*b* provides frictional force between the gear 301*b* and the gear shaft 303*b*. When the external load does not exceed the frictional force provided by the elastic element 304*b*, the gear 301*b* is restricted by the frictional force, and is stationary relative to the gear shaft 303*b*. Thus, relative rotation between the gear 301*b* and the gear shaft 303*b* is prevented.

As shown in FIG. 3*c*, in another embodiment, the elastic element between the gear and the gear shaft is shown as the reference numeral 304*c*. The elastic element 304*c* is in C-shaped, and an opening end of the elastic element extends upwards to form extension ends, namely, protruding ends. The elastic element 304*c* is sheathed on the gear shaft 303*c*. A recess matched with the extension ends is arranged in the inner wall of the gear 301*c*. The extension ends are clamped in the recess of the gear 301*c*. The elastic element 304*c* provides frictional force between the gear 301*c* and the gear shaft 303*c*. When the external load does not exceed the frictional force provided by the elastic element 304*c*, the gear 301*c* is restricted by the frictional force, and is stationary relative to the gear shaft 303*c*. Thus, relative rotation between the gear 301*c* and the gear shaft 303*c* is prevented.

There is a variety of available shapes for the elastic element and a variety of connection manners among the elastic element and the gear and the gear shaft. The shapes and the connection manners are not limited to those listed in the present application. Any elastic element in the existing art and the future art that can be connected between the gear and the gear shaft and provides frictional force can be applied to the present application, which will not be elaborated herein.

Figure 5:
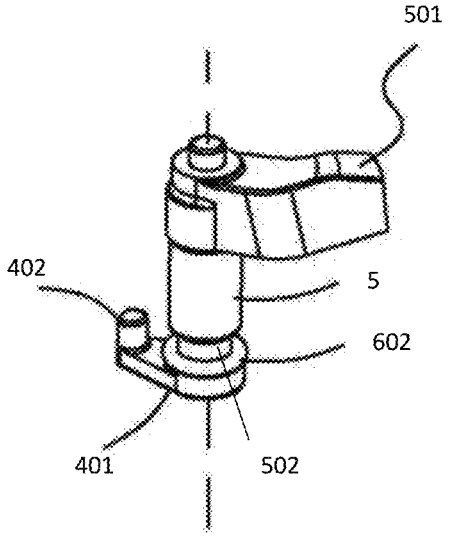
FIG. 5 is a schematic structural view of the connecting mechanism and the locking mechanism of a lock according to an embodiment of the present application.

Referring to FIG. 1 and FIG. 5, the connecting mechanism 4 comprises a crank rod 401. One end of the crank rod 401 may be connected to the sliding block 302 by rotational shaft 402. In an embodiment, the end of the crank rod 401 is connected to the lower portion of the sliding block 302. The other end of the crank rod 401 is connected to a main rotational shaft 502 of the locking mechanism 5. In addition, the main rotational shaft 502 is capable of rotating relative to the base 1 by the driving of the crank rod 401. That is, when the sliding block 302 moves linearly, the main rotational shaft 502 is capable of rotating relative to the base 1. Further, the main rotational shaft 502 is sheathed by the locking portion 501, and is coaxial with the locking portion 501. Thus, the locking portion 501 may rotate to unfold or retract relative to the base 1.

Figure 6:
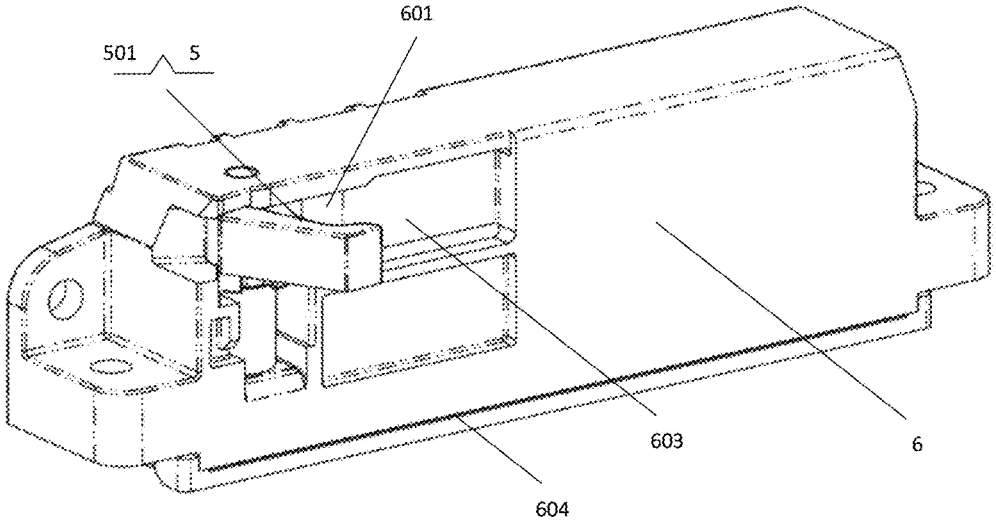
FIG. 6 is a schematic structural view of a lock connected to a shell according to an embodiment of the present application.

Referring to FIG. 6, in an embodiment, the lock 100 provided by embodiments of the present application further includes a housing 6.

The housing 6 is buckled to the base 1, and an accommodating cavity is formed between the housing 6 and the base 1. The accommodating cavity may be configured to accommodate the driving mechanism 2, the sliding mechanism 3, the connecting mechanism 4 and the locking mechanism 5.

The housing 6 defines a rotation area 601 allowing the locking portion 501 to rotate, such that the locking portion 501 may rotate flexibly to unfold or retract.

Figure 7:
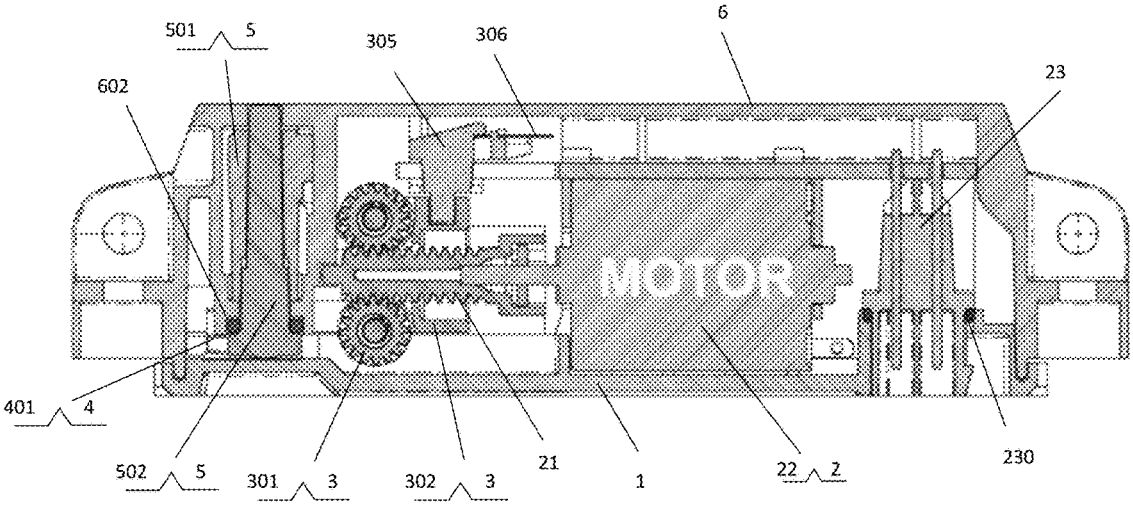
FIG. 7 is an overall cross-sectional view of a lock according to an embodiment of the present application in which the base and the shell are connected.

Further, due to the presence of the rotation area 601, the housing 6 is not completely sealed, and moisture or impurities may enter the accommodating cavity via a gap between the housing 6 and the main rotational shaft 502. As shown in FIG. 7, a joint between the main rotational shaft 502 and the housing 6 is sealed by a sealing ring 602, thereby preventing moisture and impurities from entering via the gap between the main rotational shaft 502 and the housing 6 and protecting components in the accommodating cavity. The sealing ring 602 may be an O-ring, but not merely limited to an O-ring.

Referring to FIG. 6, in an embodiment, a receiving window 603 is disposed on the outer side of the housing 6. When the locking portion 501 is in an initial position, i.e., a retracted state, the locking portion 501 may be received in the receiving window 603. In this way, the locking portion 501 in the initial position does not protrude relative to the housing 6, so as to ensure the overall appearance.

Referring to FIG. 1 and FIG. 6, in an embodiment, the housing 6 is matched with the base 1 on their joint via saw-teethed surfaces. Specifically, as shown in 1, a first saw-teethed surface 101 is disposed at the edge of the top surface of the base 1 and extends in a circumferential direction of the base 1. As shown in FIG. 6, a second saw-teethed surface 604 is disposed at the edge of the bottom surface of the housing 6. The second saw-teethed surface 604 corresponds to the first saw-teethed surface and extends in a circumferential direction of the housing 6. By the matching of the first saw-teethed surface 101 and the second saw-teethed surface 604, the housing 6 may be connected to the base 1 more closely, thereby preventing external moisture and impurities from entering.

In an embodiment, the housing 6 is sealed to the base 1 by ultrasonic welding.

Referring to FIGS. 1, 2 and 7, in an embodiment, the driving mechanism 2 further includes a socket 23. The driving unit 22 may be a motor, but is not merely limited thereto. The socket 23 may be directly connected to a power source, for example, to a control panel in a washing machine, thereby omitting unnecessary wire harness and saving the space. Therefore, components in the lock 100 may be powered by connecting the socket 23. The driving unit 22 is connected to the socket 23, so as to be connected to the power source for power output. Either direct current or alternating current may be used in the technical solution of the present application.

Further, referring to FIG. 7, a joint between the socket 23 and the base 1 is sealed by a sealing ring 230 to prevent moisture or impurities from entering the accommodating cavity via the gap between the socket 23 and the base 1. The sealing ring 230 may be an O-ring, but not merely limited to an O-ring.

Referring to FIGS. 1, 2 and 7, in an embodiment, the lock further includes a circuit board and an indication block 305, wherein the circuit board has or connected to a control system and is electrically connected to the socket 23, and the sliding block 302 is connected to the indication block 305 and may drive the same to slide. The indication block is connected to an elastic piece 306 which contacts a trigger unit of the circuit board when the indication block slides to a position. The control system may stop the rotation of the screw rod driven by the driving unit according to the contact between the elastic piece and the trigger unit.

According to an embodiment, the socket 23 may also be connected to a magnetic reed switch 231. The magnetic reed switch 231 is connected to the control system and is conducted by the magnetic force, i.e., when the magnetic reed switch 231 is not subjected to the magnetic force, the magnetic reed switch 231 is not conducted; while, when the magnetic reed switch 231 is subjected to the magnetic force, the magnetic reed switch 231 is conducted. For example, further Referring to FIGS. 8 to 11, when the lock 100 is utilized as a lid lock structure, a magnet may be placed in the upper lid 7, and when the upper lid 7 is buckled towards the casing 8, the magnetic reed switch 231 is conducted to the control system by the magnetic force of the magnet. The control system at this moment may determine that the upper lid 7 has been buckled, and then start the driving unit 22, such that the driving unit 22 rotates forwards and drives the locking portion 501 to rotate and unfold so as to be locked in a locking hole 701.

According to a second aspect of embodiments of the present application, a lid lock structure in which the lock 100 is disposed is provided. The lock 100 may be applied to various fields in the lid lock structure, and preferably suitable for a lid lock structure of a wave-type washing machine.

Figure 8:
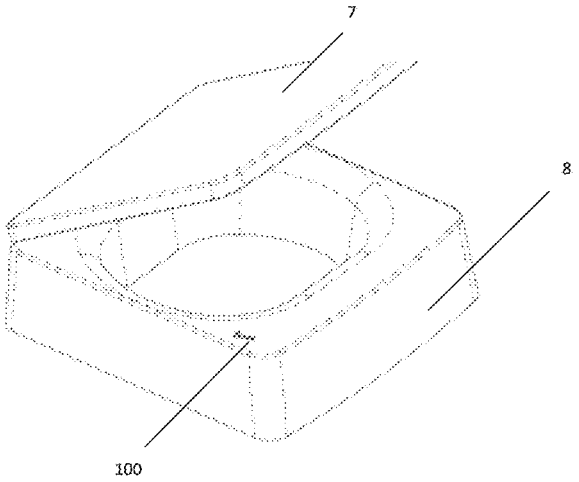
FIG. 8 is a schematic structural view of a lid lock structure according to an embodiment of the present application.
Figure 9:
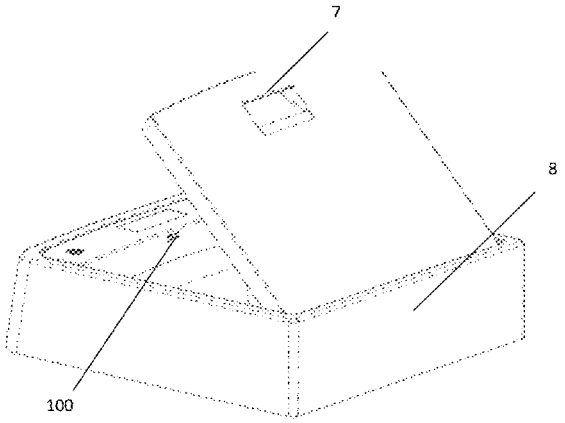
FIG. 9 is a schematic structural view of a lid lock structure according to another embodiment of the present application.

Referring to FIGS. 8 and 9, in an embodiment, the lid lock structure comprises an upper lid 7, a casing 8 and the above door block 100. The upper lid 7 is configure to be buckled to the casing 8, and the lock 100 is disposed in the casing 8. The position, rather than the structure, of the lock 100 is shown in drawings.

Referring to FIG. 8, in an embodiment, the lock 100 is arranged in the casing 8 in a vertical manner, and the locking portion 501 rotates outwards towards the upper portion of the casing 8.

Referring to FIG. 9, in another embodiment, the lock 100 is arranged in the casing 8 in a horizontal manner, and the locking portion 501 rotates outwards towards the interior of the casing 8.

Figure 10:
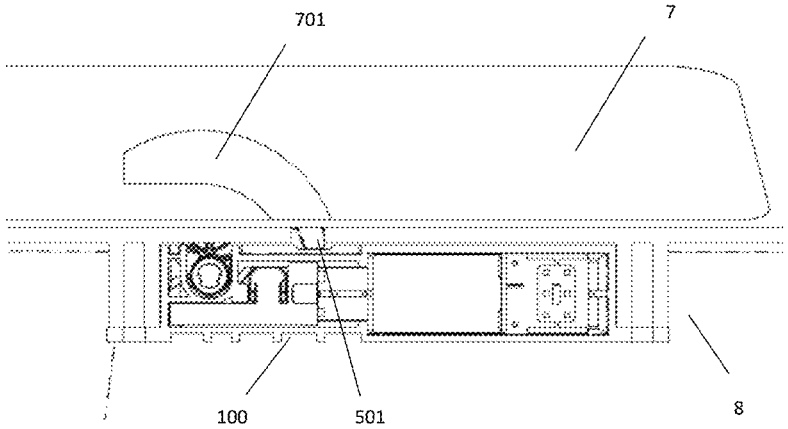
FIG. 10 is a schematic structural view of a lid lock structure according to an embodiment of the present application in which the locking portion is in a retracted state.
Figure 11:
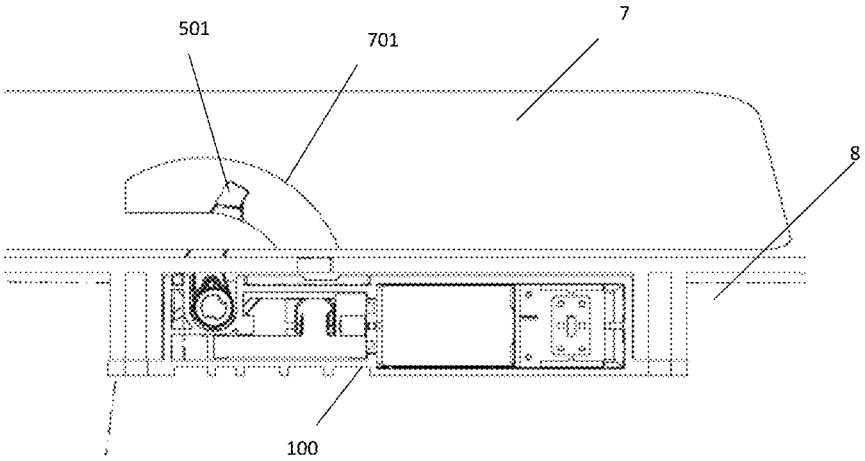
FIG. 11 is a schematic structural view of a lid lock structure according to an embodiment of the present application in which the locking portion is in an unfolded state.

Referring to FIGS. 10 and 11, in another embodiment, a locking hole 701 is disposed in the upper lid 7 at a position corresponding to the lock 100.

As shown in the state transition from FIG. 10 to FIG. 11, when the locking portion 501 rotates clockwise and unfolds relative to the base 1, the locking portion 501 may extend out relative to the casing 8, and extend to the upper lid 7 and into the locking hole 701, thereby completing locking.

As shown in the state transition from FIG. 11 to FIG. 10, when the locking portion 501 rotates counterclockwise and retracts relative to the base 1, the locking portion 501 may be retracted relative to the casing 8 and into the casing 8, thereby releasing locking.

According to a third aspect of embodiments of the present application, a manual unlocking mode is provided.

Figure 12:
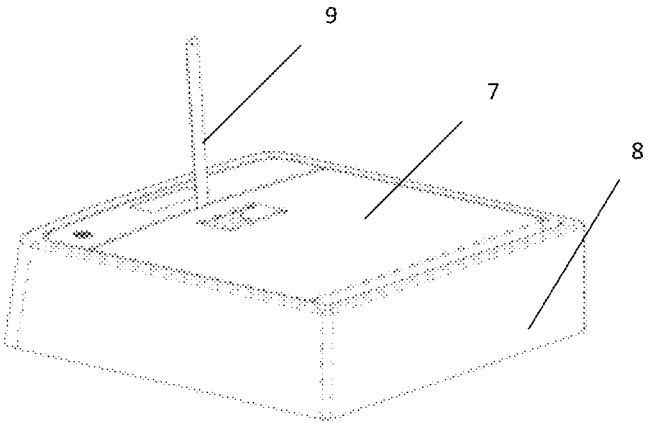
FIG. 12 is a schematic view of a lid lock structure according to another embodiment of the present application when manual unlocking needs to be performed.
Figure 13:
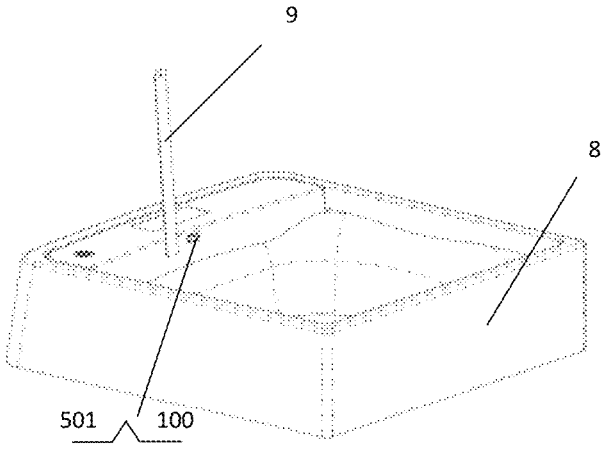
FIG. 13 is a schematic view of a lid lock structure according to yet another embodiment of the present application when manual unlocking needs to be performed.
Figure 14:
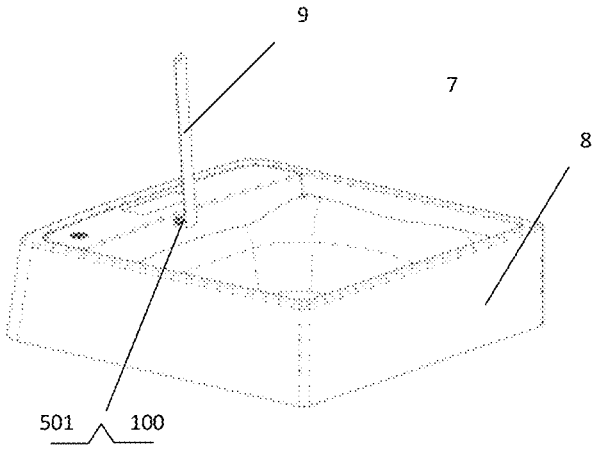
FIG. 14 is a schematic view of a lid lock structure according to yet another embodiment of the present application when manual unlocking needs to be performed.

Referring to FIGS. 12 to 14, in an embodiment, when the upper lid 7 cannot be opened due to the power failure or failure of electric operations, a sheet-like plate 9, which may be a ruler or a hard cardboard, may be inserted into a gap between the upper lid 7 and the casing 8.

Further Referring to FIGS. 13 and 14, the sheet-like plate 9 is operated to move towards a direction from which the locking portion 501 is retracted. Combining with state transition from FIG. 2 to FIG. 1, when the sheet-like plate 9 applies an external force to the locking portion 501, the external force is transmitted to the gear 301 via the crank rod 401 and the sliding block 302. When the magnitude of the external force has exceeded the frictional force provided by the elastic element 304, the gear 301 starts to engage with the screw rod 21 against the frictional force and moves linearly, returning back to the initial position together with the locking portion 501. At this moment, the locked state is released, and the upper lid 7 may be manually opened normally. In this way, the manual unlocking mode is very convenient without opening or detaching any component of the upper lid 7 and the casing 8.

In the description of the present specification, the reference terms such as "an embodiment", "some embodiments", "an example", "a specific example" or "some examples" and the like mean that the particular features, structures, materials or characteristics described in combination of the embodiments or examples are included in at least one embodiment or example of the present application. Furthermore, the described particular features, structures, materials or characteristics may be combined in a proper manner in any one or more embodiments or examples. In addition, in the absence of contradiction, one skilled in the art can integrate and combine different embodiments or examples described in this specification and the features of different embodiments or examples.

In addition, the terms "first" and "second" are used for a descriptive purpose only and shall not be construed as indicating or implying relative importance or implicitly indicating the number of the indicated technical features. Thus, features defining "first" and "second" may explicitly or implicitly include at least one of the features. In the description of the present application, "a plurality of" means two or more, unless expressly limited otherwise.

In addition, the functional units in the embodiments of the present application may be integrated in a processing module, or may exist as physically independent units. Two or more units may also be integrated into one module. The integrated module can be realized in the form of hardware or in the form of a software function module. When the integrated module is realized in a form of the software function module and is sold or used as an independent product, it may be stored in a computer-readable storage medium. The storage medium may be a read-only memory, a magnetic disk, an optical disk, or the like.

The content described above are specific embodiments of the present application, but the protection scope of the present application is not limited thereto. Any person skilled in the art may easily anticipate various alternations or replacements of these embodiments within the technical scope disclosed in the present application, and all these alternations or replacements should be covered by the protection scope of the present application. Therefore, the protection scope of the present application should be defined by the claims.

What is claimed is:

1. A lock for an appliance, the lock comprising a base, a housing connected to the base and defining a cavity therein, a driving mechanism arranged within the housing cavity, a sliding mechanism, a connecting mechanism and a locking mechanism which are disposed on the base, the driving mechanism comprising a driving unit and a screw rod, the driving unit driving the screw rod to rotate;

the sliding mechanism comprising a gear and a sliding block connected to the gear, the gear being engaged with the screw rod, to drive the sliding block to move linearly with the rotation of the screw rod;

the connecting mechanism comprising a first end connected to the sliding block, and a second end connected to the locking mechanism, the connecting mechanism converting the linear movement of the sliding block into rotational movement of the locking mechanism;

the locking mechanism having a main body and being rotatably connected to the base to define an axis of rotation of the locking mechanism main body; and the locking mechanism further comprising a locking portion that extends from the locking mechanism main body has an outer end, to unfold or retract relative to the base along with the rotation of the locking mechanism, wherein the outer end of the locking portion moves outside of the housing cavity while unfolding relative to the base by rotating in unison with the locking mechanism main body.

2. A lock for an appliance, the lock comprising a base, a driving mechanism, a sliding mechanism, a connecting mechanism and a locking mechanism which are disposed on the base, the driving mechanism comprising a driving unit and a screw rod, the driving unit driving the screw rod to rotate;

the sliding mechanism comprising a gear and a sliding block connected to the gear, the gear being engaged with the screw rod, to drive the sliding block to move linearly with the rotation of the screw rod;

the connecting mechanism comprising a first end connected to the sliding block, and a second end connected to the locking mechanism, the connecting mechanism converting the linear movement of the sliding block into rotational movement of the locking mechanism;

the locking mechanism being rotatably connected to the base;

the locking mechanism comprising a locking portion, to unfold or retract relative to the base along with the rotation of the locking mechanism; and wherein the sliding mechanism comprises a pair of gears which are engaged on two opposite sides of the screw rod symmetrically.

3. A lock for an appliance, the lock comprising a base, a driving mechanism, a sliding mechanism, a connecting mechanism and a locking mechanism which are disposed on the base, the driving mechanism comprising a driving unit and a screw rod, the driving unit driving the screw rod to rotate;

the sliding mechanism comprising a gear and a sliding block connected to the gear, the gear being engaged with the screw rod, to drive the sliding block to move linearly with the rotation of the screw rod;

the connecting mechanism comprising a first end connected to the sliding block, and a second end connected to the locking mechanism, the connecting mechanism converting the linear movement of the sliding block into rotational movement of the locking mechanism;

the locking mechanism being rotatably connected to the base;

the locking mechanism comprising a locking portion, to unfold or retract relative to the base along with the rotation of the locking mechanism; and wherein the gear is connected to the sliding block via a gear shaft, and an elastic element is disposed between the gear and the gear shaft for providing a frictional force between the gear and the gear shaft to prevent a relative rotation therebetween.

4. The lock according to claim 3, wherein the gear shaft has a stepped contour and comprises a first stepped portion and a second stepped portion, the inner surface of the gear is matched with the stepped contour of the gear shaft and comprises a first stepped surface corresponding to the first stepped portion and a second stepped surface corresponding to the second stepped portion, and the elastic element is clamped on the first stepped portion and is in interference fit with the second stepped surface.

5. The lock according to claim 3, wherein the elastic element is sheathed on the gear shaft and comprises a protruding end clamped in a recess in the inner wall of the gear.

6. A lock for an appliance, the lock comprising a base, a driving mechanism, a sliding mechanism, a connecting mechanism and a locking mechanism which are disposed on the base, the driving mechanism comprising a driving unit and a screw rod, the driving unit driving the screw rod to rotate;

the sliding mechanism comprising a gear and a sliding block connected to the gear, the gear being engaged with the screw rod, to drive the sliding block to move linearly with the rotation of the screw rod;

the connecting mechanism comprising a first end connected to the sliding block, and a second end connected to the locking mechanism, the connecting mechanism converting the linear movement of the sliding block into rotational movement of the locking mechanism;

the locking mechanism being rotatably connected to the base;

the locking mechanism comprising a locking portion, to unfold or retract relative to the base along with the rotation of the locking mechanism; and wherein the sliding block comprises a guide portion, the guide portion comprises an extension portion perpendicular to the movement direction of the sliding block, the extension portion comprising a guide hole, the screw rod passing through the guide hole of the guide portion, and a gap is left between the guide hole and the screw rod.

7. The lock according to claim 6, wherein the connecting mechanism comprises a crank rod, and the locking mechanism comprises a main rotational shaft, the locking portion being sheathed on the main rotational shaft, the crank rod comprises one end connected to the sliding block and the other end connected to the main rotational shaft, and when the sliding block moves, the main rotational shaft is capable of rotating relative to the base under the driving of the crank rod, so as to drive the locking portion to rotate.

8. The lock according to claim 7, further comprising a housing, the housing being buckled to the base, and an accommodating cavity being formed between the housing and the base;

the accommodating cavity accommodating the driving mechanism, the sliding mechanism, the connecting mechanism and the locking mechanism;

the housing defining a rotation area allowing the locking portion to rotate; and a joint between the main rotational shaft and the housing being sealed by a sealing ring.

9. The lock according to claim 8, wherein a receiving window is disposed on the outer side of the housing, to accommodate the locking portion in an initial position.

10. The lock according to claim 9, wherein the housing is matched with and connected to the base via a saw-teethed surface, or the housing is sealed to the base by welding.

11. The lock according to claim 10, wherein the driving mechanism further comprises a socket, the socket is connected with a power source to power the driving unit and is connected to the driving unit, and a joint between the socket and the base is sealed by a sealing ring.

12. The lock according to claim 11, further comprising a circuit board and an indication block, wherein the circuit board is configured to control the driving unit and is electrically connected to the socket, and the sliding block is connected to the indication block and drives the same to slide;

the indication block is connected to an elastic piece which contacts a trigger unit of the circuit board when the indication block slides to a position; and the circuit board control the driving unit to stop the rotation of the screw rod driven by the driving unit according to the contact between the elastic piece and the trigger unit.

13. A lock for an appliance, the lock comprising a base, a driving mechanism, a sliding mechanism, a connecting mechanism and a locking mechanism which are disposed on the base, the driving mechanism comprising a driving unit and a screw rod, the driving unit driving the screw rod to rotate;

the sliding mechanism comprising a gear and a sliding block connected to the gear, the gear being engaged with the screw rod, to drive the sliding block to move linearly with the rotation of the screw rod;

the connecting mechanism comprising a first end connected to the sliding block, and a second end connected to the locking mechanism, the connecting mechanism converting the linear movement of the sliding block into rotational movement of the locking mechanism;

the locking mechanism being rotatably connected to the base;

the locking mechanism comprising a locking portion, to unfold or retract relative to the base along with the rotation of the locking mechanism;

wherein:

the upper lid is configured to be buckled to the casing;

the lock is configured to be disposed in the casing a locking hole is disposed in the upper lid at a position corresponding to the lock; and the locking portion is configured to be rotatable relative to the casing to extend out of the same, for being locked in the locking hole.

14. The lid lock according to claim 13, wherein the lock is arranged in the casing in a vertical manner, and the locking portion rotates outwards towards the upper portion of the casing.

15. The lid lock according to claim 13, wherein the lock is arranged in the casing in a horizontal manner, and the locking portion rotates outwards towards the interior of the casing.

16. The lid lock according to claim 13, wherein a gap is provided between the upper lid and the casing, to accommodate a sheet-like plate which slides in the gap.

* * * * *